US011473395B2

(12) United States Patent
Yeldell et al.

(10) Patent No.: US 11,473,395 B2
(45) Date of Patent: Oct. 18, 2022

(54) DOWNHOLE CHECK VALVE ASSEMBLY WITH A LOCKING MECHANISM

(71) Applicant: Halliburton Energy Services, Inc., Houston, TX (US)

(72) Inventors: Stephen A. Yeldell, Humble, TX (US); Kevin W. Ardoin, Spring, TX (US); Lonnie C. Helms, Humble, TX (US); Min M. Yuan, Katy, TX (US); Frank Acosta, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 27 days.

(21) Appl. No.: 16/960,229

(22) PCT Filed: Feb. 27, 2018

(86) PCT No.: PCT/US2018/020034
§ 371 (c)(1),
(2) Date: Jul. 6, 2020

(87) PCT Pub. No.: WO2019/168507
PCT Pub. Date: Sep. 6, 2019

(65) Prior Publication Data

US 2021/0062611 A1 Mar. 4, 2021

(51) Int. Cl.
*E21B 33/129* (2006.01)
*E21B 34/08* (2006.01)
*E21B 33/14* (2006.01)

(52) U.S. Cl.
CPC ..... *E21B 33/1294* (2013.01); *E21B 33/1292* (2013.01); *E21B 33/14* (2013.01); *E21B 34/08* (2013.01)

(58) Field of Classification Search
CPC .. E21B 33/1294; E21B 33/14; E21B 33/1292; E21B 34/08
See application file for complete search history.

(56) References Cited

U.S. PATENT DOCUMENTS 2,121,002 A * 6/1938 Baker ..... E21B 33/134 166/120
2,378,469 A * 6/1945 Denton ..... E21B 33/134 166/122

(Continued)

OTHER PUBLICATIONS

International Search Report and Written Opinion dated Nov. 27, 2018 for PCT/US2018/020034 filed Feb. 27, 2018. pp. 16.

*Primary Examiner* — Jonathan Malikasim
(74) *Attorney, Agent, or Firm* — K&L Gates LLP

(57) ABSTRACT

Valve systems and methods for inserting into a casing in a downhole environment are provided. A valve system includes a tool mandrel, a check valve assembly, and a setting system. The setting system includes a sealing element, wedges, slips, and a set nut. Each of the wedges and slips includes an inner surface slidable along the outer surface of the tool mandrel. Each wedge includes a primary angled surface and a secondary angled surface. The wedges are located between the slips and the secondary angled surface of one wedge is in contact to the secondary angled surface of the other wedge. Each of the slips includes an outer surface including gripping elements configured to grip an inner surface of the casing. Also, each of the slips includes an angled side surface configured to engage with the primary angled surface of the wedge.

18 Claims, 7 Drawing Sheets

(56) References Cited

U.S. PATENT DOCUMENTS

| | | | | | |
|---|---|---|---|---|---|
| 4,708,202 | A | * | 11/1987 | Sukup | E21B 33/1204 166/122 |
| 4,762,177 | A | | 8/1988 | Smith, Jr. | |
| 4,842,082 | A | * | 6/1989 | Springer | E21B 10/32 175/279 |
| 4,934,459 | A | * | 6/1990 | Baugh | E21B 23/01 166/380 |
| 5,379,835 | A | * | 1/1995 | Streich | E21B 33/1294 166/181 |
| 6,920,927 | B2 | * | 7/2005 | Hirth | E21B 33/1291 166/206 |
| 7,128,154 | B2 | | 10/2006 | Giroux et al. | |
| 8,336,616 | B1 | | 12/2012 | McClinton | |
| 9,416,617 | B2 | | 8/2016 | Wiese et al. | |
| 2008/0073086 | A1 | | 3/2008 | Cook et al. | |
| 2010/0139911 | A1 | | 6/2010 | Stout | |
| 2013/0008671 | A1 | | 1/2013 | Booth | |
| 2015/0068728 | A1 | | 3/2015 | Stage et al. | |
| 2015/0300122 | A1 | | 10/2015 | George et al. | |
| 2017/0044859 | A1 | | 2/2017 | Blair | |

* cited by examiner

DOWNHOLE CHECK VALVE ASSEMBLY WITH A LOCKING MECHANISM

BACKGROUND

This section is intended to provide relevant background information to facilitate a better understanding of the various aspects of the described embodiments. Accordingly, it should be understood that these statements are to be read in this light and not as admissions of prior art.

Check valves and other floating equipment can be installed above ground within a pipe or casing and used during downhole operations, such as for controlling fluid flow. The check valve is installed into a segment of pipe which is later connected to the casing. The valve is assembled into this segment via concrete, resin, or even threading. Problems may be caused during the downhole operation if a check valve becomes unattached or slips from within the casing.

Therefore, there is a need for a check valve assembly that reliably maintains a gas-tight seal with the inner surface of the casing under relatively high pressures commonly experienced during downhole operations.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
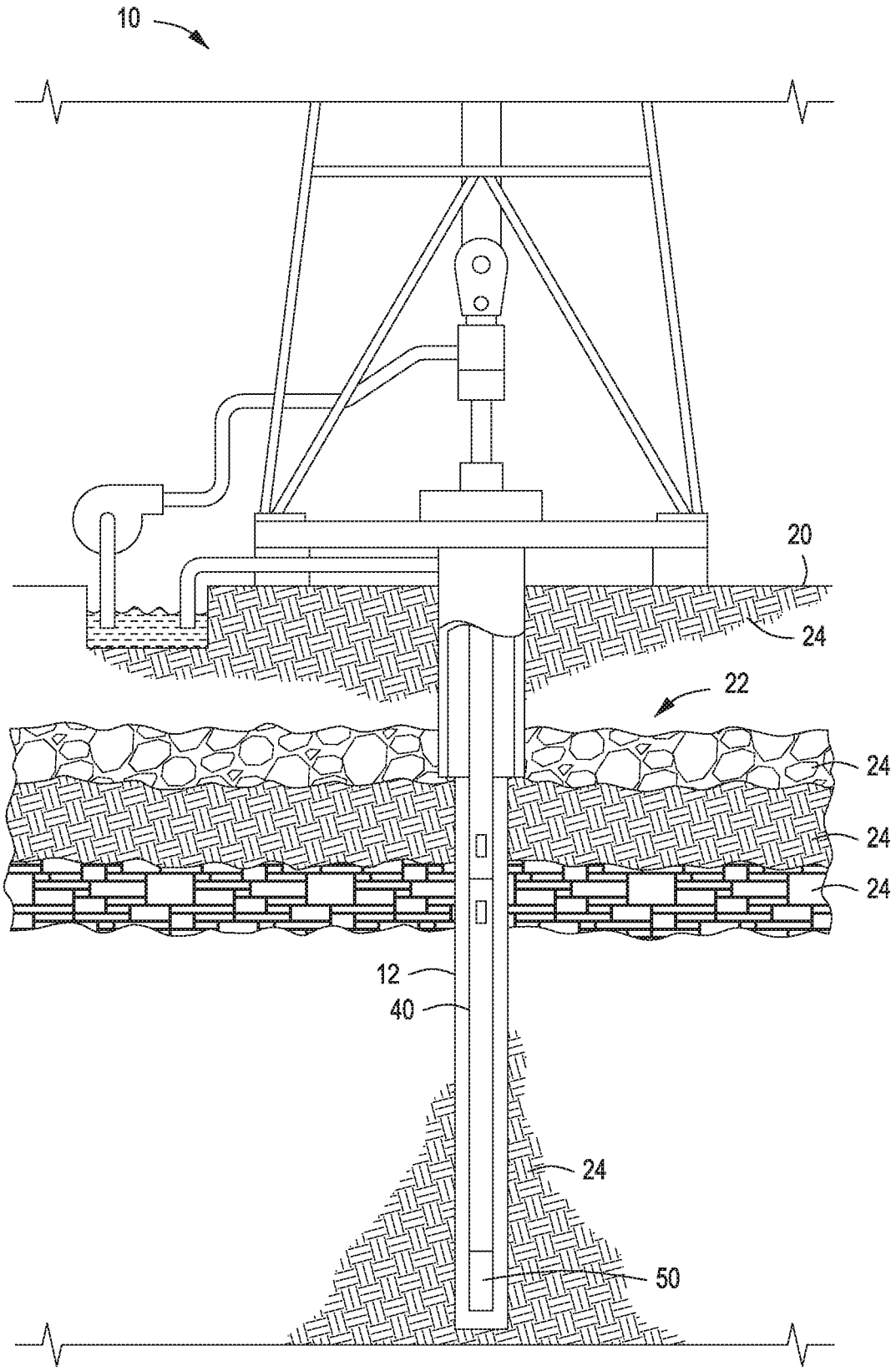
FIG. 1 depicts a schematic view of a well system including a valve system located within a casing in a downhole environment, according to one or more embodiments.

In one or more embodiments, a valve system that is insertable into a casing used in a downhole environment is provided herein. The valve system includes a tool mandrel, a check or flapper valve assembly, and a setting system. In one embodiment, the setting system includes a sealing element, a pair of wedges, a pair of slips, and a set nut and/or a ratcheting float collar, each located on an outer surface of the tool mandrel. The sealing element is located adjacent to one of the slips. Each of the wedges includes an inner surface slidable along the outer surface of the tool mandrel, a primary angled surface, and a secondary angled surface. The wedges are located between the slips and the secondary angled surface of one wedge is in contact to the secondary angled surface of the other wedge. Each of the slips includes an inner surface slidable along the outer surface of the tool mandrel and an outer surface including gripping elements configured to grip an inner surface of the casing. Also, each of the slips includes an angled side surface configured to engage with the primary angled surface of the wedge.

In another embodiment, a valve system includes a setting system that includes a sealing element, a single wedge, a pair of slips, and a set nut and/or a ratcheting float collar. The wedge includes an inner surface slidable along the outer surface of the tool mandrel, a primary angled surface, and a secondary angled surface. The slips are separated from each other by the wedge. Each of the slips includes an inner surface slidable along the outer surface of the tool mandrel and an outer surface including gripping elements configured to grip an inner surface of the casing. Each slip also includes an angled side surface configured to engage with the primary or secondary angled surface of the wedge.

In other embodiments, the valve system includes a tool mandrel, a check valve assembly, a packer mandrel, and a setting system. The packer mandrel is coupled to the tool mandrel and in fluid communication with the passageway of the tool mandrel. The setting system is located on an outer surface of the tool mandrel and includes one or more sealing elements, a pair of wedges, a pair of slips, and a set nut and/or a ratcheting float collar. In one configuration, the check valve assembly is located upstream of the packer mandrel relative to the primary direction of the fluid flow. In another configuration, the check valve assembly is located downstream of the packer mandrel relative to the primary direction of the fluid flow.

Each of the wedges includes an inner surface slidable along the outer surface of the packer mandrel and an angled surface. Each of the slips includes an inner surface configured to engage the angled surface of the wedge and an outer surface including gripping elements configured to grip an inner surface of the casing. In one or more embodiments, the sealing element includes an inner sealing component located between two outer sealing components on the outer surface of the packer mandrel. One of the wedges is in contact with one of the outer sealing components and the other wedge is in contact to the other outer sealing component.

FIG. 1 depicts a schematic view of a well system 10 including a valve system 50 that is located in a casing 40 placed into a downhole environment, including a subterranean region 22 beneath the ground surface 20, according to one or more embodiments. The valve system 50 can be a check valve, a flapper valve, or another type of valve or flow control device. A string of pipes connected together form the casing 40 that is lowered into a wellbore 12.

The subterranean region 22 includes all or part of one or more subterranean formations, subterranean zones, and/or other earth formations. The subterranean region 22 shown in FIG. 1, for example, includes multiple subsurface layers 24. The subsurface layers 24 can include sedimentary layers, rock layers, sand layers, or any combination thereof and other types of subsurface layers. One or more of the subsurface layers 24 can contain fluids, such as brine, oil, gas, or combinations thereof. The wellbore 12 penetrates through the subsurface layers 24 and although the wellbore 12 shown in FIG. 1 is a vertical wellbore, the valve system 50 can also be implemented in other wellbore orientations. For example, the valve system 50 may be adapted for horizontal wellbores, slant wellbores, curved wellbores, vertical wellbores, or any combination thereof. The valve system 50 can be or include any of the valve systems and/or the check valve assemblies described and discussed below.

Figure 2A:
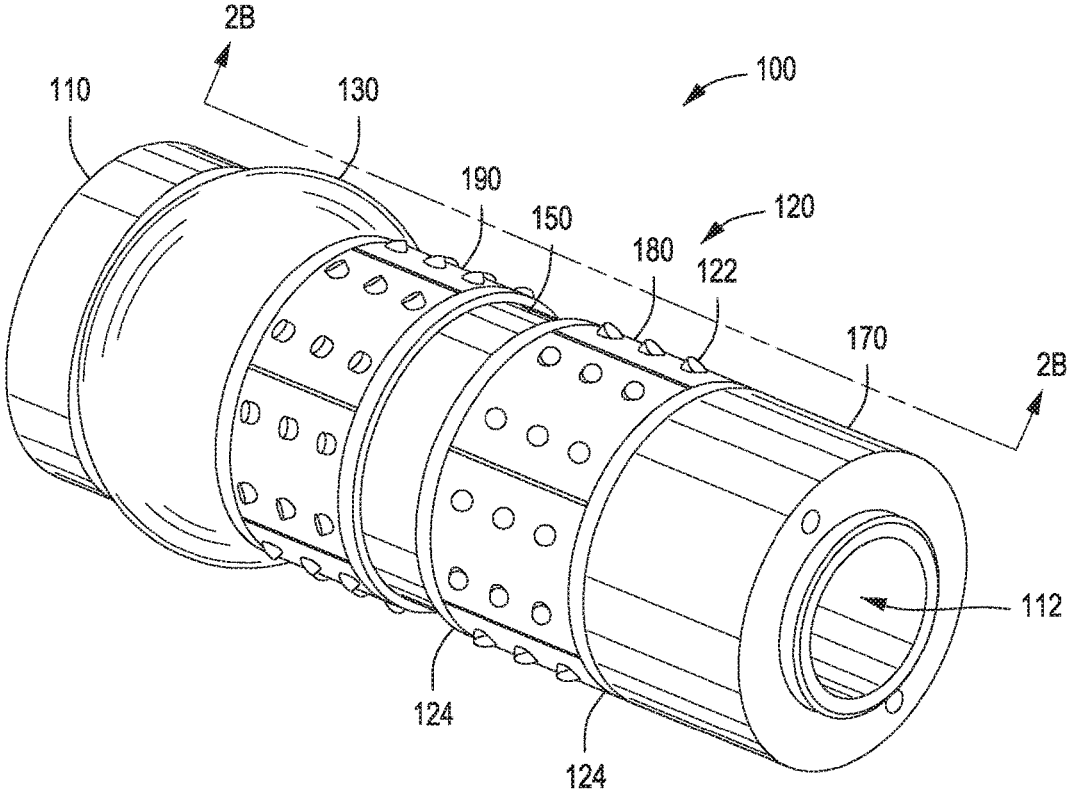
FIGS. 2A-2C are schematic views of a valve system with a locking mechanism including two setting wedges in an engaged position, according to one or more embodiments.
Figure 2B:
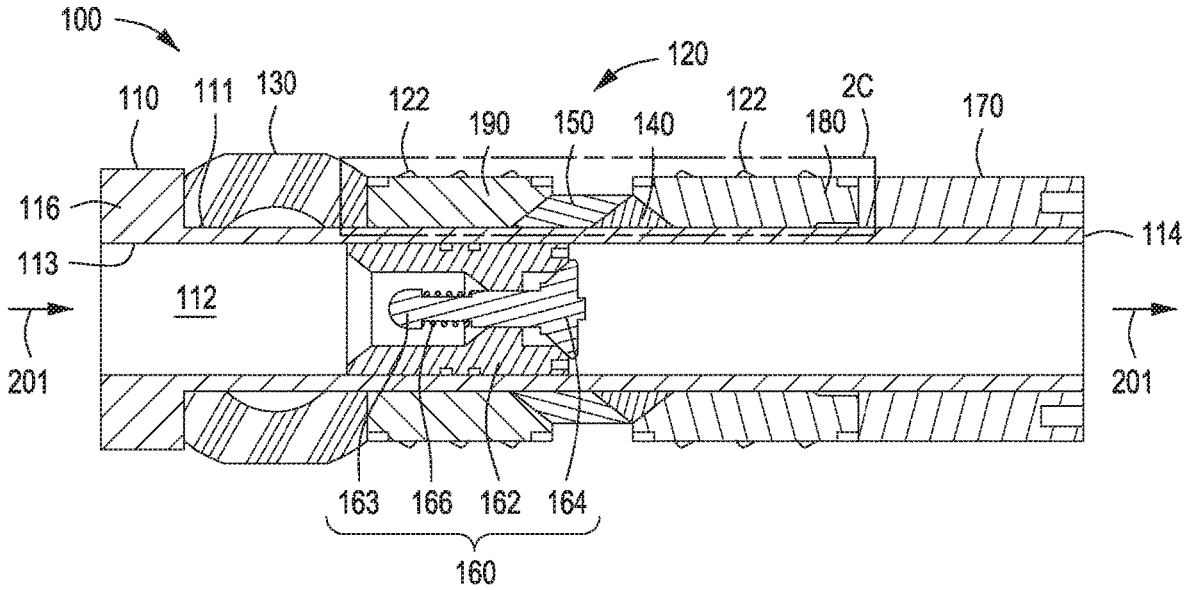
Figure 2C:
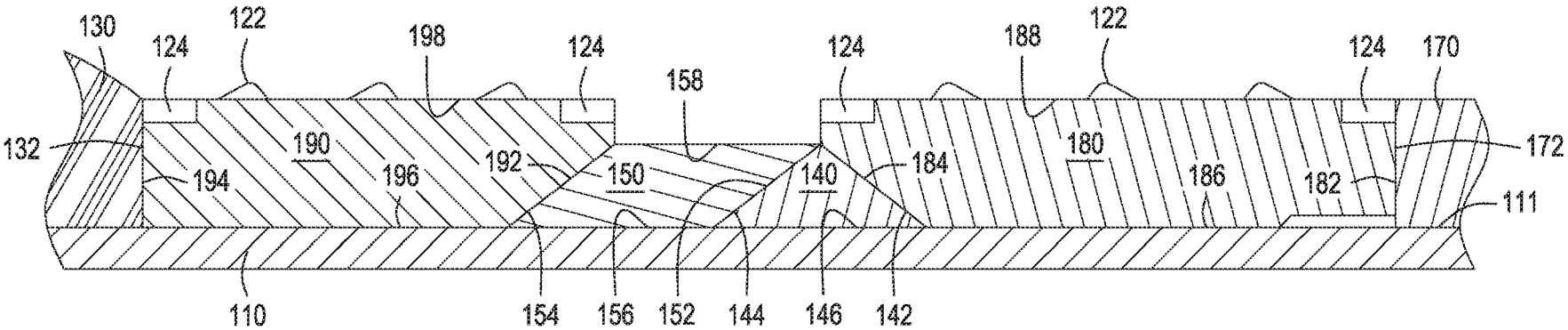

FIGS. 2A-2C are schematic views of a valve system 100 with a locking mechanism including two setting wedges in an engaged position, according to one or more embodiments. The valve system 100 can be positioned into a casing that is used in a downhole environment. The valve system 100 is insertable into the casing or pipe above ground and subsequently, the casing containing the installed valve system 100 is placed into a downhole environment, such as a borehole, a well, and/or a subterranean formation. Alternatively, the valve system 100 can be inserted into and attached inside the casing or pipe that is already positioned in a downhole environment.

The valve system 100 includes a tool mandrel 110, a setting system 120, and a check valve assembly 160 (FIGS. 2B and 2C). The setting system 120 includes one or more sealing elements 130, a pair of wedges 140, 150, and a pair of slips 180, 190 located on the tool mandrel 110. A ratcheting float collar or a set nut 170 is coupled to an end of the tool mandrel 110 and is used to hold the sealing element 130, the wedges 140, 150, and the slips 180, 190 onto the tool mandrel 110. As discussed in more detail below, the ratcheting float collar or the set nut 170 is also used to activate or engage the setting system 120 and set the valve system 100 into place within a casing.

The tool mandrel 110 includes an outer surface 111 and an inner surface 113. The inner surface 113 defines a passageway 112 extending or otherwise passing through the tool mandrel 110. The tool mandrel 110 has one end 114 downstream of another end 116 relative to the fluid flow 201 in the primary direction. The sealing element 130, the wedges 140, 150, and the slips 180, 190 are located between the end 116 and the set nut 170. As the set nut 170 is tightened onto the tool mandrel 110, the sealing element 130, the wedges 140, 150, and the slips 180, 190 are compressed together to set or lock the setting system 120 in the engaged position, as depicted in the FIGS. 2A-2C, as described and discussed in additional detail below. The set nut 170 is untightened from on the tool mandrel 110 to decompress the sealing element 130, the wedges 140, 150, and the slips 180, 190 in order to unset or unlock the setting system 120 in the unengaged position, not shown.

The check valve assembly 160 is coupled to the tool mandrel 110 and operable to allow a fluid flow 201 in a primary direction (depicted by arrows in FIG. 2B) through the passageway 112 and to prohibit the fluid flow 201 in a secondary direction (not shown) through the passageway 112 opposite of the primary direction. The check valve assembly 160 can include a valve body 162, a valve stem 163, a plunger 164, an actuator 166 (e.g., spring), and an optional engagement member (not shown). It should be appreciated that the check valve assembly 160 can include other or different components as well. Although the valve system 100 is depicted containing the check valve assembly 160, other types of valves, such as a flapper valve, can substituted for the check valve assembly 160.

As shown in FIG. 2B, fluid flowing along the path of the fluid flow 201 in the primary direction exerts sufficient pressure against the plunger 164 to overcome a force pressing the plunger 164 against the valve body 162. The force pressing the plunger 164 against the valve body 162 includes the actuator 166, as well as fluid pressure from outside of the casing produced from a flowing along a path in the secondary direction opposite of the fluid flow 201 in the primary direction. Whenever the pressure from inside the casing is less than the pressure outside of the casing, the actuator 166 and the outside pressure pushes the plunger 164 into sealing engagement with the valve body 162 therefore prohibiting fluid from flowing along the secondary direction.

The sealing element 130 is located on the outer surface 111 of the tool mandrel 110. The sealing element 130 can be or include, but is not limited to, one or more O-rings, O-seals, packer elements, or any combination thereof. The sealing element 130 can contain one or more polymers, oligomers, rubbers (natural and/or synthetic), silicones, or any combinations thereof. The sealing element 130 forms a gas-tight seal when in sealing engagement with the inner surface of the casing.

Depicted in FIG. 2C, the wedges 140, 150 are located on the outer surface 111 of the tool mandrel 110. The wedge 140 includes angled surfaces 142, 144 and an inner surface 146. The wedge 150 includes angled surfaces 152, 154, an inner surface 156, and an outer surface 158. The inner surfaces 146, 156 are slidable along the outer surface 111 of the tool mandrel 110. As depicted, the wedge 140 has a shape of a triangle and the wedge 150 has a shape of a parallelogram. Together, the wedges 140 and 150 have a shape of a trapezoid including the outer surface 158 that is parallel to the combined inner surfaces 146, 156. In another embodiment, not shown, the wedge 140 has a shape of a parallelogram and the wedge 150 has a shape of a triangle.

The slips 180, 190 are located on the tool mandrel 110 and separated from each other by the pair of wedges 140, 150. The slip 180 is located between the wedge 140 and the ratcheting float collar or set nut 170 and the slip 190 is located between the wedge 150 and the sealing element 130. Each of the slips 180, 190 can include multiple segments held together on the tool mandrel 110 by one, two, or more O-rings 124. The slip 180 includes a side surface 182, an angled surface 184, an inner surface 186 and an outer surface 188. The slip 190 includes an angled surface 192, a side surface 194, an inner surface 196, and an outer surface 198. The outer surfaces 188, 198 include a plurality of gripping elements 122 configured to grip an inner surface of the casing.

The gripping elements 122 can be or include, but are not limited to, one or more teeth, one or more ridges, one or more threads, or one or more slip buttons. The gripping elements 122 extend from the outer surfaces 188, 198 of the slips 180, 190. The gripping elements 122 can extend from the outer surfaces 188, 198 at an angle (as shown in FIGS. 2A-2C), or alternative, the gripping elements 122 can extend perpendicular from the outer surfaces 188, 198 (not shown). The gripping elements 122 are configured to make contact with and grip the inner surface of the casing. Once in contact, the gripping elements 122 produce enough friction against the inner surface of the casing to hold the valve system 100 into place within the casing.

The gripping elements 122 generally contain a material durable enough to withstand the pressures and temperatures experienced downhole in the casing. The gripping elements 122 can contain, but are not limited to, one or more materials that include metal (e.g., cast iron, steel, aluminum, magnesium, or alloys thereof), metal carbide (e.g., tungsten carbide), ceramic, thermoplastic (e.g., phenolic resins or plastic), or any combinations thereof. In another embodiment, the gripping elements 122 contain a dissolvable material that can be readily dissolved or deteriorated when exposed to an aqueous fluid, such as a cement or a water-based mud, that is an acidic or alkaline. Exemplary dissolvable materials can be or include, but are not limited to, one or more of aluminum, magnesium, aluminum-magnesium alloy, iron, alloys thereof, degradable polymer, or any combination thereof.

The ratcheting float collar or set nut 170 is located around at least a portion of the tool mandrel 110 adjacent to the slip 180. The ratcheting float collar or set nut 170 has an inner surface that includes a first set of ratchet teeth or threads for engaging the tool mandrel 110. The tool mandrel 110 includes a second set of ratchet teeth or threads that is located on the outer surface 111 of the tool mandrel 110. The second set of ratchet teeth or threads of the tool mandrel 110 is configured to engage the first set of ratchet teeth or threads on the ratcheting float collar or set nut 170.

The first set of ratchet teeth or threads and the second set of ratchet teeth or threads form a ratcheting system that is operable to radially move the outer surface 188, 198 of the slips 180, 190 towards the inner surface of the casing. The first set of ratchet teeth or threads and the second set of ratchet teeth or threads are operable to allow outwardly radially movement between the slips 180, 190 and disallow inwardly radially movement of the slips 180, 190. For example, as depicted in FIG. 2C, when the set nut 170 is tightened, an inner surface 172 of the set nut 170 engages the side surface 182 of the slip 180 which axially moves the slip 180 into the wedge 140, into the wedge 150, into the slip 190, and into a side surface 132 of the sealing element 130. The slips 180, 190 radially move away from the tool mandrel 110 and to the casing. Specifically, the slip 180 is moved up the angled surface 184 of the wedge 140 and the slip 190 is moved up the angled surface 154 of the wedge 150. Also, the sealing element 130 is axially compressed and radially expanded, such as radially moved away from the tool mandrel 110 and to the casing.

Figure 3C:
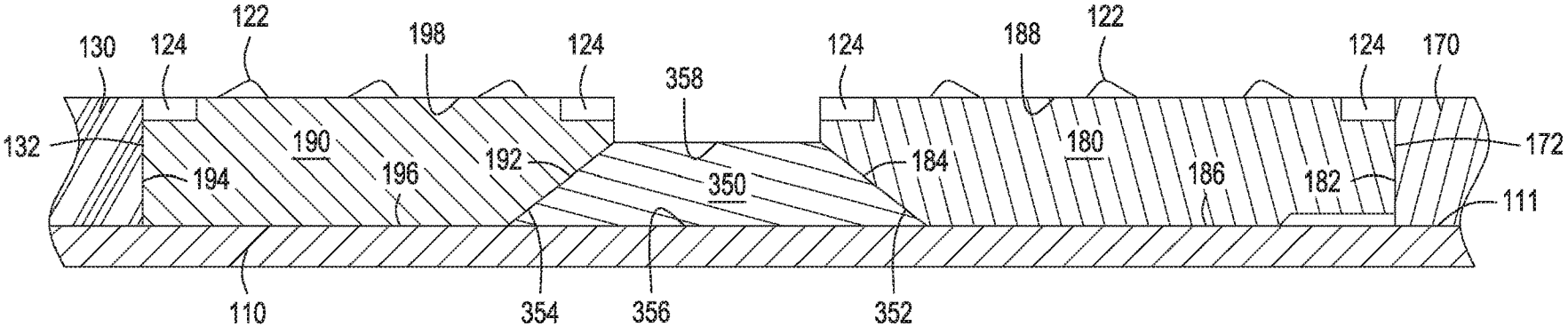
FIGS. 3A-3C are schematic views of a valve system with another locking mechanism including a single set wedge in an unengaged position, according to one or more embodiments.
Figure 3A:
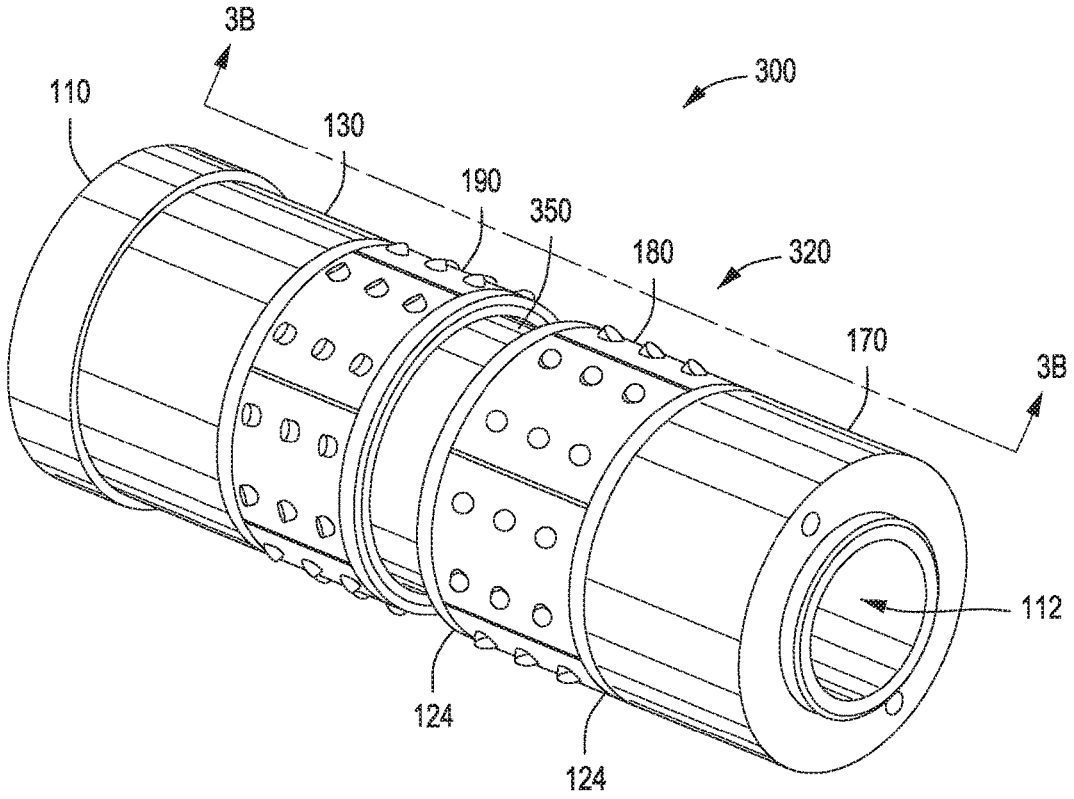
Figure 3B:
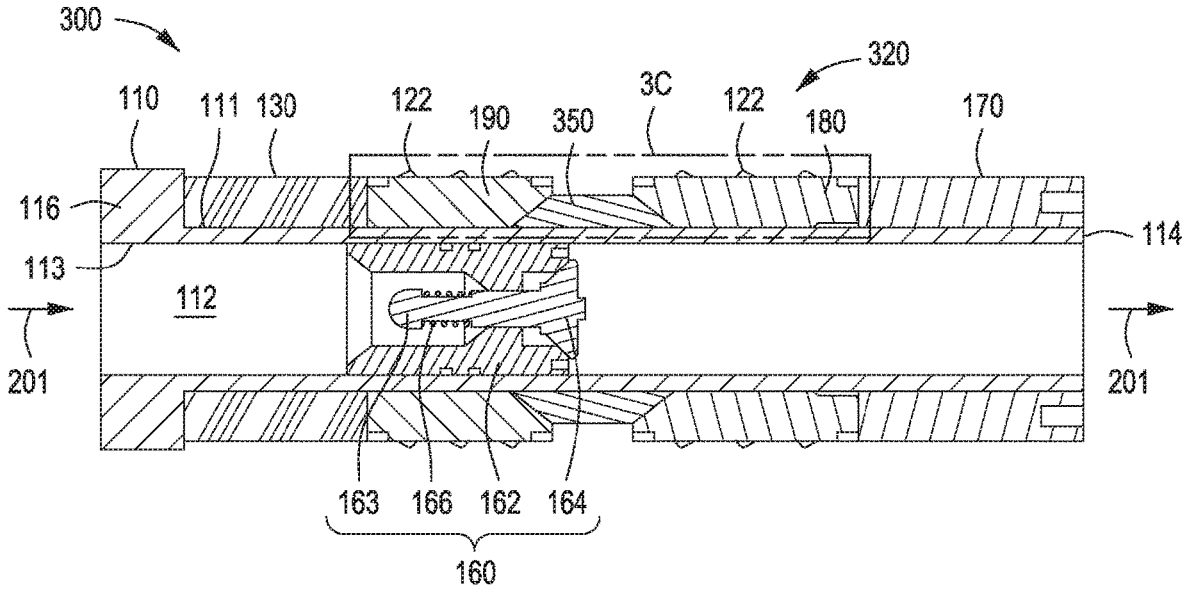

FIGS. 3A-3C are schematic views of a valve system 300 with another locking mechanism including a single set wedge 350 in an unengaged position, according to one or more embodiments. A setting system 320 differs from the setting system 120 by including the wedge 350, instead of the wedges 140, 150.

The setting system 320 includes one or more sealing elements 130, the wedges 350, and a pair of slips 180, 190 located on the tool mandrel 110. The ratcheting float collar or a set nut 170 is coupled to the tool mandrel 110 and is used to hold the sealing element 130, the wedge 350, and the slips 180, 190 onto the tool mandrel 110. As discussed in more detail below, the ratcheting float collar or the set nut 170 is also used to activate or otherwise engage the setting system 320 and lock the valve system 300 into place within a casing.

The sealing element 130, the wedge 350, and the slips 180, 190 are located between the end 116 and the set nut 170. The set nut 170 is attached to the end 114 of the tool mandrel 110. As the set nut 170 is tightened onto the tool mandrel 110, the sealing element 130, the wedge 350, and the slips 180, 190 are compressed together to set or lock the setting system 320 in the engaged position, not shown. The set nut 170 is untightened from on the tool mandrel 110 to decompress the sealing element 130, the wedge 350, and the slips 180, 190 in order to unset or unlock the setting system 320 in the unengaged position, as depicted in FIGS. 3A-3C.

As depicted in FIG. 3C, the wedge 350 is located on the outer surface 111 of the tool mandrel 110. The wedge 350 includes angled surfaces 352, 354, an inner surface 356, and an outer surface 358. The inner surface 356 is slidable along the outer surface 111 of the tool mandrel 110. The angled surface 352 is in contact with the angled surface 184 of the slip 180 and the angled surface 354 is in contact with the angled surface 192 of the slip 190. As depicted, the wedge 35 has a shape of a trapezoid including the outer surface 358 that is parallel to the inner surface 356.

As depicted in FIG. 3C, when the set nut 170 is tightened, an inner surface 172 of the set nut 170 engages the side surface 182 of the slip 180 which axially moves the slip 180 into the wedge 350, into the slip 190, and into a side surface 132 of the sealing element 130. The slips 180, 190 radially move away from the tool mandrel 110 and the sealing element 130 is axially compressed and radially expanded. Specifically, the slip 180 is moved up the angled surface 352 of the wedge 350 and the slip 190 is moved up the angled surface 354 of the wedge 350.

Figure 4A:
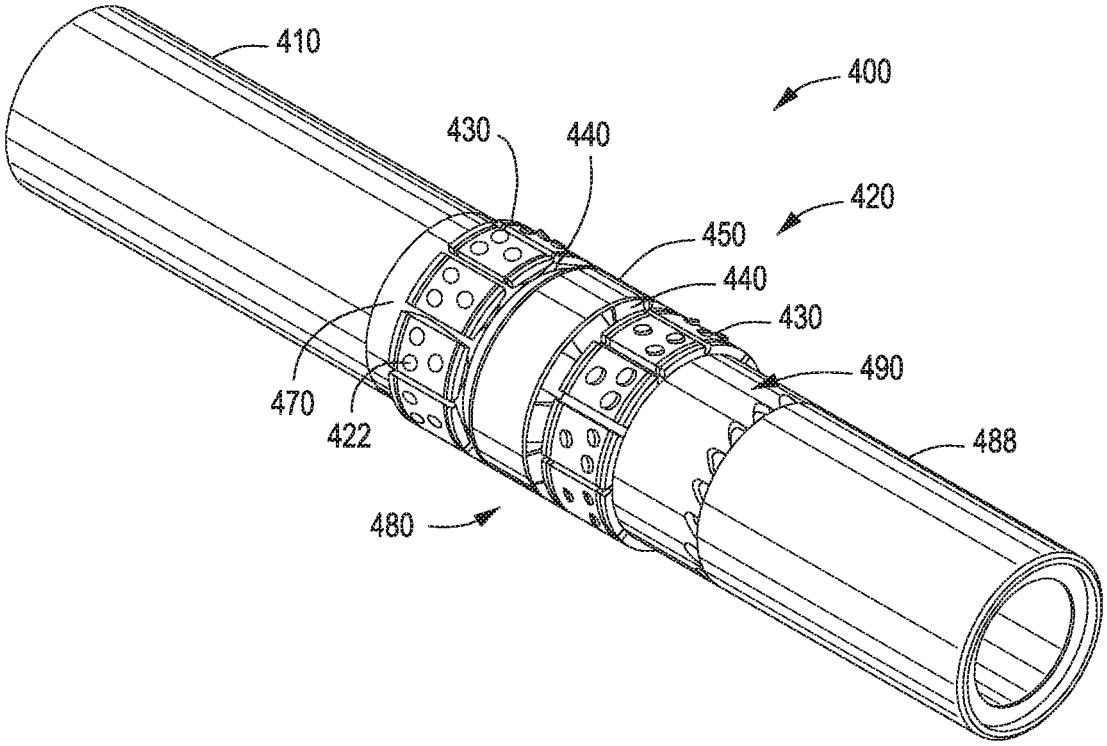
FIGS. 4A and 4B are schematic views of another valve system including a setting system located on a packer coupled upstream to a check valve assembly, according to one or more embodiments.
Figure 4B:
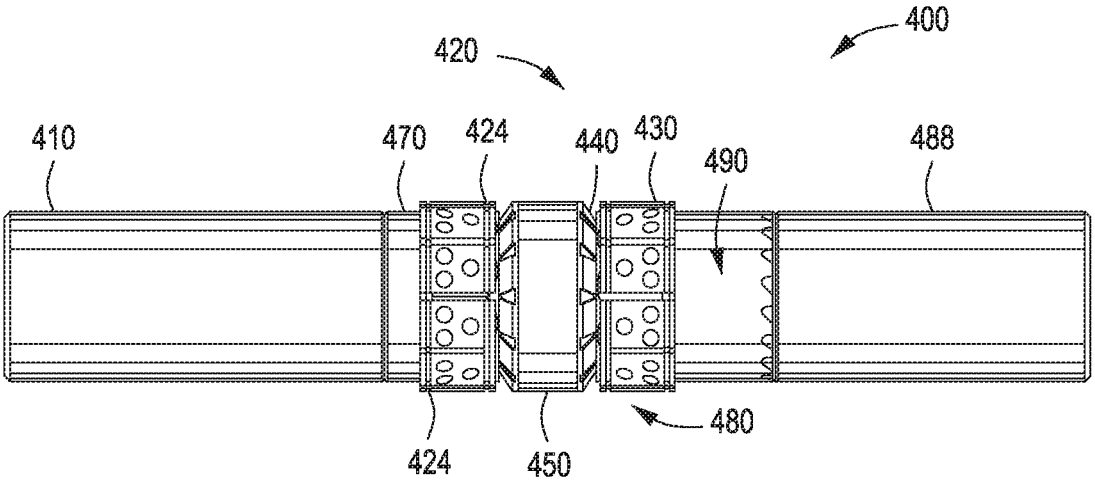
Figure 5:
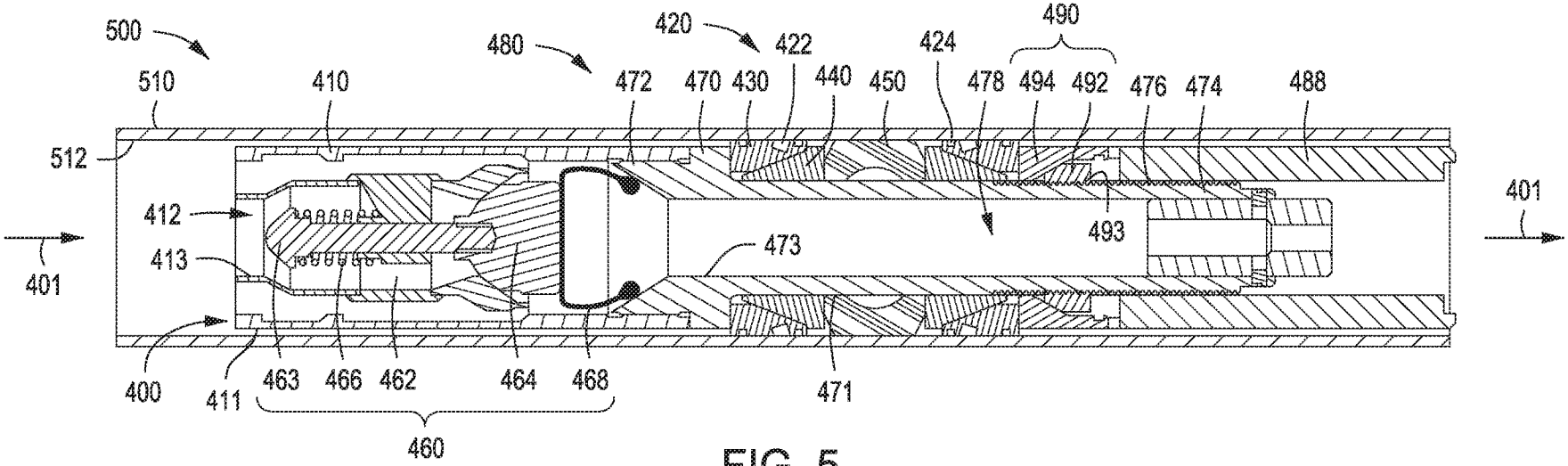
FIG. 5 is a cross-sectional schematic view of the valve system depicted in FIGS. 4A and 4B positioned in a casing, according to one or more embodiments.

FIGS. 4A, 4B, and 5 are schematic views of a valve system 400 including a setting system 420 located on a packer 480, according to one or more embodiments. The valve system 400 can be positioned in a casing that is used in a downhole environment. The valve system 400 is insertable into the casing or pipe above ground and subsequently, the casing containing the installed valve system 400 is placed into a downhole environment, such as a borehole, a well, and/or a subterranean formation. Alternatively, the valve system 400 can be inserted into and attached inside the casing or pipe that is already positioned in a downhole environment.

FIG. 5 depicted a cross-sectional schematic view of a system 500 that includes the valve system 400 positioned in a casing 510. The valve system 400 includes a tool mandrel 410, the setting system 420, a check valve assembly 460, and a packer mandrel 470. The setting system 420 is located on the packer mandrel 470 and the check valve assembly 460 is located in the tool mandrel 410. The check valve assembly 460 is coupled upstream to the packer 480. Specifically, the check valve assembly 460 is positioned upstream of the packer mandrel 470 relative to a fluid flow 401 in a primary direction (depicted by arrows in FIG. 5).

The tool mandrel 410 includes an outer surface 411 and an inner surface 413. The inner surface 413 defines a passageway 412 extending or otherwise passing through the tool mandrel 410. The packer mandrel 470 includes an outer surface 471 and an inner surface 473. The inner surface 473 defines a passageway 478 extending or otherwise passing through the packer mandrel 470. The packer mandrel 470 includes one end 472 coupled to the tool mandrel 410 and another end 474 coupled to a sleeve 488. As depicted in FIG. 5, the passageway 412 of the tool mandrel 410 and the passageway 478 of the packer mandrel 470 are in fluid communication with each other and the fluid flow 401 passes therethrough.

The check valve assembly 460 is coupled to the tool mandrel 410 and operable to allow the fluid flow 401 in the primary direction (shown in FIG. 5) through the passageway 412 and to prohibit the fluid flow 401 in a secondary direction (not shown) through the passageway 412 opposite of the primary direction. The check valve assembly 460 can include a valve body 462, a valve stem 463, a plunger 464, an actuator 466 (e.g., spring), and an engagement member 468. It should be appreciated that the check valve assembly 460 can include other or different components as well. Although the valve system 400 is depicted containing the check valve assembly 460, other types of valves, such as a flapper valve, can substituted for the check valve assembly 460.

As shown in FIG. 5, fluid flowing along the path of the fluid flow 401 in the primary direction exerts sufficient pressure against the plunger 464 to overcome a force pressing the plunger 464 against the valve body 462. The force pressing the plunger 464 against the valve body 462 includes the actuator 466, as well as fluid pressure from outside of the casing produced from a flowing along a path in the secondary direction opposite of the fluid flow 401 in the primary direction. Whenever the pressure from inside the casing is less than the pressure outside of the casing, the actuator 466 and the outside pressure pushes the plunger 464 into sealing engagement with the valve body 462 therefore prohibiting fluid from flowing along the secondary direction.

The setting system 420 includes a pair of slips 430, a pair of wedges 440, and one or more sealing elements 450 located on the packer mandrel 470. The setting system 420 also includes a set nut and/or ratcheting float collar 490 located on the packer mandrel 470. The ratcheting float collar 490 is used to hold the slips 430, the wedges 440, and the sealing element 450 onto the packer mandrel 470. As discussed in more detail below, the ratcheting float collar 490 is also used to activate or engage the setting system 420 and set the valve system 400 into place within the casing 510, as well as to deactivate or disengage the setting system 420 and release the valve system 400 from the casing 510.

As depicted in FIG. 5, the wedges 440 are located on the outer surface 471 of the packer mandrel 470. The wedges 440 are separated from each other by the sealing element 450. Each of the wedges 440 can include multiple segments held together on the packer mandrel 470 by one, two, or more O-rings 424. Each wedge 440 includes an inner surface, a side surface, and an angled surface. The inner surface of the wedge 440 is in contact with and slidable along the outer surface 471 of the packer mandrel 470. The side surfaces of the wedge 440 are in contact with and operable to compress and depress the sealing elements 450. The angled surfaces of the wedge 440 are in contact with the slips 430.

The slips 430 are located on the outer surface 471 of the packer mandrel 470. The slips 430 are separated from each other by the wedges 440. Each of the slips 430 includes an inner surface and an outer surface. The inner surfaces of the slips 430 are configured to engage the angled surfaces of the wedge 440. The outer surfaces of the slips 430 include gripping elements 422.

The gripping elements 422 can be or include, but are not limited to, one or more teeth, one or more ridges, one or more threads, or one or more slip buttons. The gripping elements 422 extend from the slips 430. The gripping elements 422 can extend from the slips 430 at an angle (as shown in FIGS. 4A and 4B), or alternative, the gripping elements 422 can extend perpendicular from the slips 430 (not shown). The gripping elements 422 are configured to make contact with and grip the inner surface 512 of the casing 510. Once in contact, the gripping elements 422 produce enough friction against the inner surface 512 to hold the valve system 400 into place within the casing 510.

The gripping elements 422 generally contain a material durable enough to withstand the pressures and temperatures experienced downhole in the casing. The gripping elements 422 can contain, but are not limited to, one or more materials that include metal (e.g., cast iron, steel, aluminum, magnesium, or alloys thereof), metal carbide (e.g., tungsten carbide), ceramic, thermoplastic (e.g., phenolic resins or plastic), or any combinations thereof. In another embodiment, the gripping elements 422 contain a dissolvable material that can be readily dissolved or deteriorated when exposed to an aqueous fluid, such as a cement or a water-based mud, that is an acidic or alkaline. Exemplary dissolvable materials can be or include, but are not limited to, one or more of aluminum, magnesium, aluminum-magnesium alloy, iron, alloys thereof, degradable polymer, or any combination thereof.

The sealing element 450 is located on the outer surface 471 of the packer mandrel 470. The sealing element 450 can be or include, but is not limited to, one or more O-rings, O-seals, packer elements, or any combination thereof. The sealing element 450 can contain one or more polymers, oligomers, rubbers (natural and/or synthetic), silicones, or any combinations thereof. The sealing element 450 forms a gas-tight seal when in sealing engagement with the inner surface of the casing.

The ratcheting float collar 490 is located around at least a portion of the packer mandrel 470 adjacent to one of the slips 430. The ratcheting float collar 490 includes a collar 492 and a ramp 494 at least located around the end 474 of the packer mandrel 470. The ratcheting float collar 490 has an inner surface that includes a first set of ratcheting teeth 493 for engaging the packer mandrel 470. More specifically, the collar 492 includes the ratcheting teeth 493 that engage a plurality of ratcheting teeth 476 located on the outer surface 471 of the end 474 of the packer mandrel 470. The second set of ratcheting teeth 476 of the packer mandrel 470 is configured to engage the first set of ratcheting teeth 493 on the collar 492 of the ratcheting float collar 490.

The first set of ratcheting teeth 493 and the second set of ratcheting teeth 476 form a ratcheting system that is operable to radially move the outer surface of the slips 430 towards the inner surface 512 of the casing 510. The first set of ratcheting teeth 493 and the second set of ratcheting teeth 476 are operable to allow outwardly radially movement between the slips 430 and disallow inwardly radially movement of the slips 430. For example, as depicted in FIG. 5, when the ratcheting float collar 490 is tightened, the collar 492 engages the ramp 494 into the side surface of the slip 430 which axially and radially moves the slip 430 into and onto the wedge 440, and the wedge 440 axially moves into the side surface of the sealing element 450. Also, the sealing element 450 axially moves into the second wedge 440 that axially and radially moves the second slip 430 into the end 472 of the packer mandrel 470 and onto the second wedge 440. The slips 430 radially move away from the packer mandrel 470 and to the casing 510. Specifically, each slip 430 is moved up the angled surface of the adjacent wedge 440. Also, the sealing element 450 is axially compressed and radially expanded, such as radially moved away from the packer mandrel 470 and to the casing 510.

Figure 7:
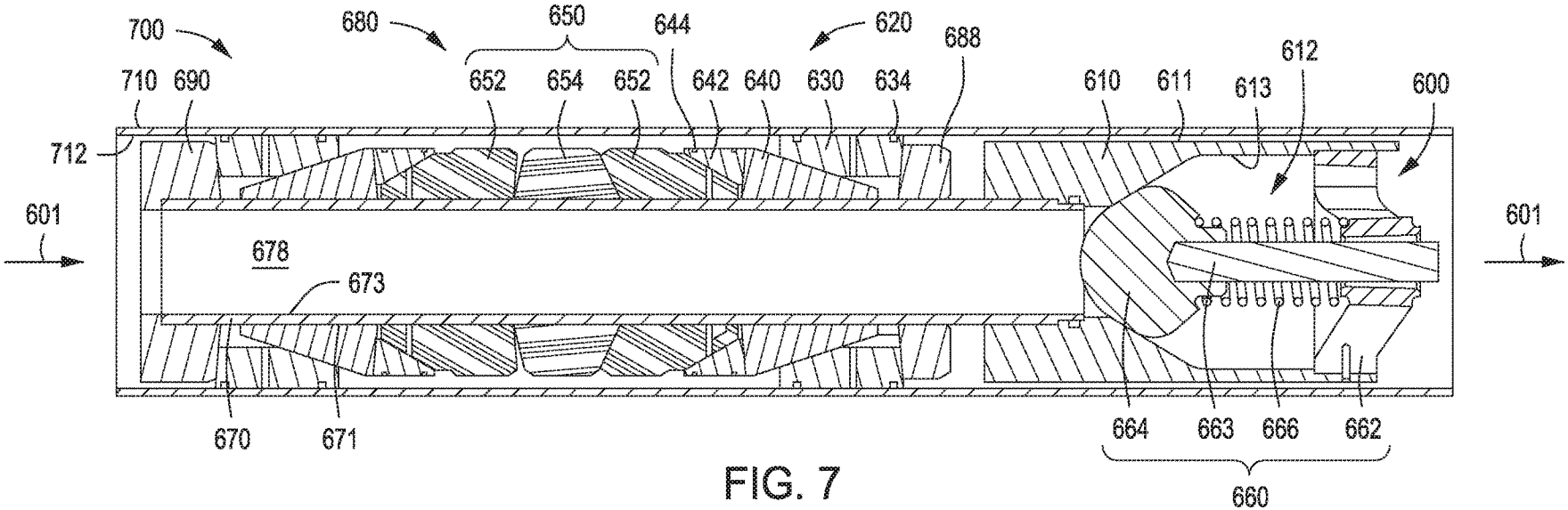
FIG. 7 is a cross-sectional schematic view of the valve system depicted in FIGS. 6A and 6B positioned in a casing, according to one or more embodiments.
Figure 6A:
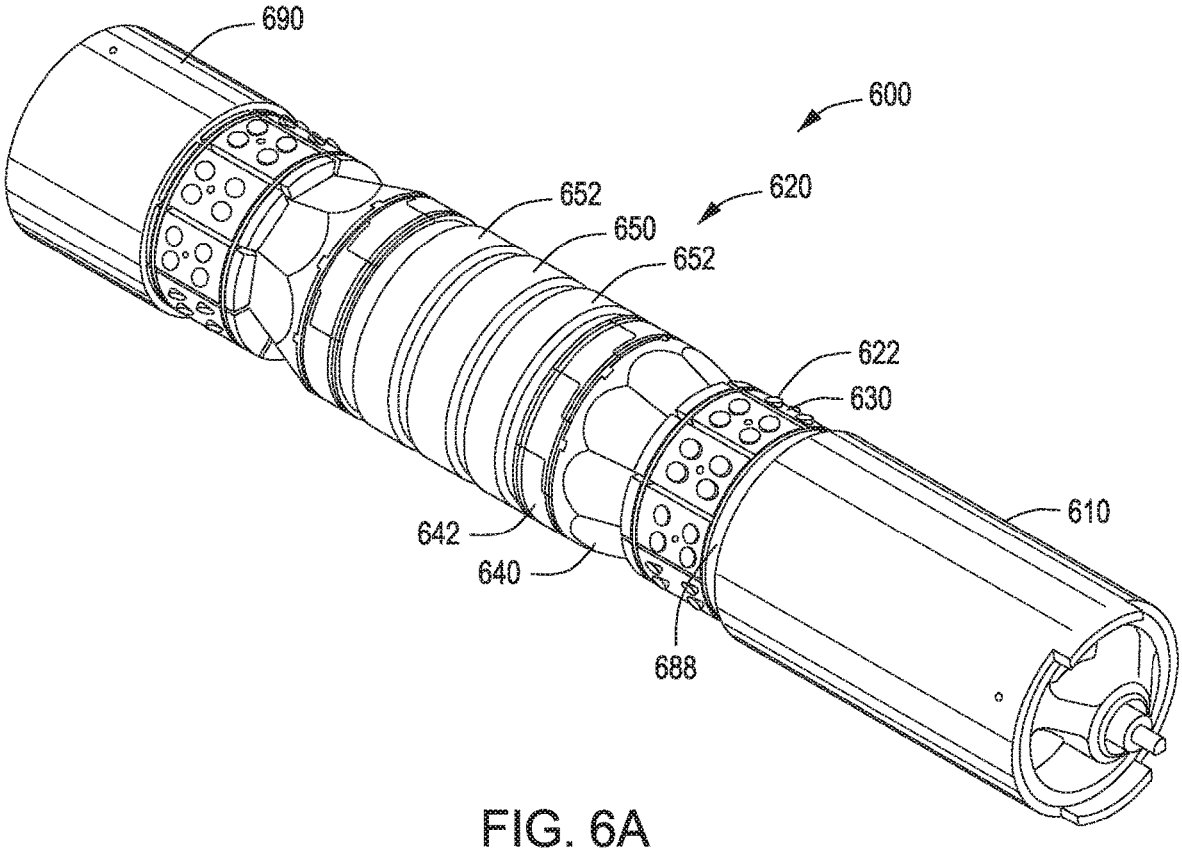
FIGS. 6A and 6B are schematic views of another valve system including a setting system located on a packer coupled downstream to a check valve assembly, according to one or more embodiments.
Figure 6B:
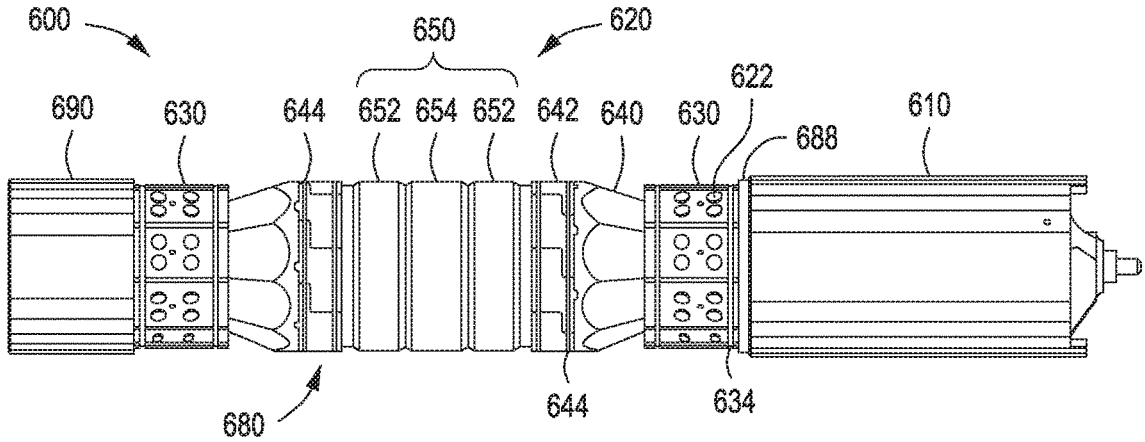

FIGS. 6A, 6B, and 7 are schematic views of a valve system 600 including a setting system 620 located on a packer 680, according to one or more embodiments. The valve system 600 can be positioned in a casing that is used in a downhole environment. The valve system 600 is insertable into the casing or pipe above ground and subsequently, the casing containing the installed valve system 600 is placed into a downhole environment, such as a borehole, a well, and/or a subterranean formation. Alternatively, the valve system 600 can be inserted into and attached inside the casing or pipe that is already positioned in a downhole environment.

FIG. 7 depicted a cross-sectional schematic view of a system 700 that includes the valve system 600 positioned in a casing 710. The valve system 600 includes a tool mandrel 610, the setting system 620, a check valve assembly 660, and a packer mandrel 670. The setting system 620 is located on the packer mandrel 670 and the check valve assembly 660 is located in the tool mandrel 610. The check valve assembly 660 is coupled downstream to the packer 680. Specifically, the check valve assembly 660 is positioned downstream of the packer mandrel 670 relative to a fluid flow 601 in a primary direction (depicted by arrows in FIG. 7).

The tool mandrel 610 includes an outer surface 611 and an inner surface 613. The inner surface 613 defines a passageway 612 extending or otherwise passing through the tool mandrel 610. The packer mandrel 670 includes an outer surface 671 and an inner surface 673. The inner surface 673 defines a passageway 678 extending or otherwise passing through the packer mandrel 670. The packer mandrel 670 is coupled to the tool mandrel 610. As depicted in FIG. 7, the passageway 612 of the tool mandrel 610 and the passageway 678 of the packer mandrel 670 are in fluid communication with each other and the fluid flow 601 passes therethrough.

The check valve assembly 660 is coupled to the tool mandrel 610 and operable to allow the fluid flow 601 in the primary direction (shown in FIG. 7) through the passageway 612 and to prohibit the fluid flow 601 in a secondary direction (not shown) through the passageway 612 opposite of the primary direction. The check valve assembly 660 can include a valve body 662, a valve stem 663, a plunger 664, an actuator 666 (e.g., spring), and an optional engagement member (not shown). It should be appreciated that the check valve assembly 660 can include other or different components as well. Although the valve system 600 is depicted containing the check valve assembly 660, other types of valves, such as a flapper valve, can substituted for the check valve assembly 660.

As shown in FIG. 7, fluid flowing along the path of the fluid flow 601 in the primary direction exerts sufficient pressure against the plunger 664 to overcome a force pressing the plunger 664 against the valve body 662. The force pressing the plunger 664 against the valve body 662 includes the actuator 666, as well as fluid pressure from outside of the casing produced from a flowing along a path in the secondary direction opposite of the fluid flow 601 in the primary direction. Whenever the pressure from inside the casing is less than the pressure outside of the casing, the actuator 666 and the outside pressure pushes the plunger 664 into sealing engagement with the valve body 662 therefore prohibiting fluid from flowing along the secondary direction.

The setting system 620 includes a pair of slips 630, a pair of wedges 640, and one or more sealing elements 650 located on the packer mandrel 670. The setting system 620 also includes one or more ratcheting float collars and/or one or more set nuts 688, 690 located on the packer mandrel 670. The set nuts 688, 690 are used to hold the slips 630, the wedges 640, and the sealing element 650 onto the packer mandrel 670. As discussed in more detail below, the set nuts 688, 690 are also used to activate or engage the setting system 620 and set the valve system 600 into place within the casing 710, as well as to deactivate or disengage the setting system 620 and release the valve system 600 from the casing 710.

As depicted in FIG. 7, the wedges 640 are located on the outer surface 671 of the packer mandrel 670. The wedges 640 are separated from each other by the sealing element 650. Each of the wedges 640 can include multiple segments held together on the packer mandrel 670 by one, two, or more O-rings 644. Each of the wedges 640 can also include an element 642, such as an arm or other extension. Each wedge 640 includes an inner surface, a side surface, and an angled surface. The inner surface of the wedge 640 is in contact with and slidable along the outer surface 671 of the packer mandrel 670. The side surfaces of the wedge 640 and/or the element 642 are engageable with the sealing element 650 to compress the sealing element 650. The angled surface of the wedge 640 is in contact with the slips 630.

The slips 630 are located on the outer surface 671 of the packer mandrel 670. The slips 630 are separated from each other by the wedges 640. Each of the slips 630 can include multiple segments held together on the packer mandrel 670 by one, two, or more O-rings 634. Each of the slips 630 includes an inner surface and an outer surface. The inner surface of the slips 630 is configured to engage the angled surface of the wedge 640. The outer surface of the slips 630 includes gripping elements 622 configured to grip an inner surface 712 of the casing 710.

The gripping elements 622 can be or include, but are not limited to, one or more teeth, one or more ridges, one or more threads, or one or more slip buttons. The gripping elements 622 extend from the slips 630. The gripping elements 622 can extend from the slips 630 at an angle (as shown in FIGS. 4A and 4B), or alternative, the gripping elements 622 can extend perpendicular from the slips 630 (not shown). The gripping elements 622 are configured to make contact with and grip the inner surface of the casing. Once in contact, the gripping elements 622 produce enough friction against the inner surface of the casing to hold the valve system 600 into place within the casing.

The gripping elements 622 generally contain a material durable enough to withstand the pressures and temperatures experienced downhole in the casing. The gripping elements 622 can contain, but are not limited to, one or more materials that include metal (e.g., cast iron, steel, aluminum, magnesium, or alloys thereof), metal carbide (e.g., tungsten carbide), ceramic, thermoplastic (e.g., phenolic resins or plastic), or any combinations thereof. In another embodiment, the gripping elements 622 contain a dissolvable material that can be readily dissolved or deteriorated when exposed to an aqueous fluid, such as a cement or a water-based mud, that is an acidic or alkaline. Exemplary dissolvable materials can be or include, but are not limited to, one or more of aluminum, magnesium, aluminum-magnesium alloy, iron, alloys thereof, degradable polymer, or any combination thereof.

The sealing element 650 is located on the outer surface 671 of the packer mandrel 670. The sealing element 650 can include an inner component 652 located between two outer components 654. The sealing element 650 can be or include, but is not limited to, one or more O-rings, O-seals, packer elements, or any combination thereof. The sealing element 650 can contain one or more polymers, oligomers, rubbers (natural and/or synthetic), silicones, or any combinations thereof. The sealing element 650 forms a gas-tight seal when in sealing engagement with the inner surface of the casing.

The ratcheting float collars and/or set nuts 688, 690 are located around at least a portion of the packer mandrel 670 adjacent to one of the slips 630. In one or more embodiments, the set nut 690 has an inner surface that includes a first set of threads for engaging a second set of threads located on an outer surface of the packer mandrel 670. In another embodiment, not shown, the set nut 690 is replaced with a ratcheting float collar that has an inner surface that includes a first set of ratcheting teeth for engaging the outer surface 671 of the packer mandrel 670. A second set of ratcheting teeth on the packer mandrel 670 is configured to engage the first set of ratcheting teeth on the inner surface of the set nut 690.

As depicted in FIG. 7, the setting system 620 is engaged when the set nut 690 is tightened, the set nut 690 engages the side surface of the slip 630 which axially and radially moves the slip 630 into and onto the wedge 640, and the wedge 640 axially moves into the sealing element 650 including the inner component 652 and the outer components 654. Also, the sealing element 650 axially moves into the second wedge 640 that axially and radially moves the second slip 630 and onto the second wedge 640 and against the set nut 688. The slips 630 radially move away from the packer mandrel 670 and to the casing 710. Specifically, each slip 630 is moved up the angled surface of the adjacent wedge 640. Also, the sealing element 650, including the inner component 652 and the outer components 654, is axially compressed and radially expanded, such as radially moved away from the packer mandrel 670 and to the casing 710.

During oil and gas production, the process of cementing a casing into the wellbore of an oil or gas well includes several steps. A string of casings is run in the wellbore to the desired depth. Then, a cement slurry is pumped from outside of the wellbore (e.g., ground surface) and into the casing to fill an annulus between the casing and the wellbore wall to a desired height. A displacement medium, such as a drilling or circulation fluid, is pumped behind the cement slurry in order to push the cement slurry to exit the inside of the casing and enter the annulus. The cement slurry is typically separated from the circulation fluid by at least one cementing plug. Due to the difference in specific gravity between the circulating fluid and the cement slurry, the heavier cement slurry initially drops inside the casing without being pumped by hydrostatic pressure. After the height of cement slurry column outside the casing in the annulus equals the height of the cement slurry column inside the casing, hydrostatic pressure must be exerted on the displacement fluid to force the rest of cement slurry out of the casing and into the annulus. After the desired amount of cement slurry has been pumped into the annulus, it is desirable to prevent the backflow of cement slurry into the casing until the cement slurry sets and hardens. This backflow is produced by the difference in specific gravity of the heavier cement and the lighter displacement fluid.

In one or more embodiments, a method of preventing the backflow of cement slurry involves placing a check valve, as discussed and described herein, in the lower end of the casing string to prevent the backflow of the cement slurry and/or other fluids into the casing. The check valve is generally located on a conventional casing string near or at the bottom of the casing string. Then, the cement slurry is pumped through the check valve and into the borehole. As the casing is cemented into place in the downhole or subterranean environment, the check valve prevents fluid flow into the casing from the well or formation. Since the check valve maintains the cement and/or fluid from entering the casing, the casing has more buoyancy and does not need to be supported as much as if the end of the casing was open to backflow. Cement is then pumped down the inside of the casing, out of the check valve, and back up the annulus between the casing and the wellbore wall where the cement is allowed to cure.

In addition to the embodiments described above, embodiments of the present disclosure further relate to one or more of the following paragraphs:

1. A valve system for inserting into a casing within a downhole environment, comprising: a tool mandrel comprising a passageway therethrough; a check valve assembly coupled to the tool mandrel and operable to allow a fluid flow only in a primary direction through the passageway; and a setting system comprising: a pair of wedges located on the outer surface of the tool mandrel, each of the wedges comprises: an inner surface slidable along the outer surface of the tool mandrel; and a primary angled surface; a secondary angled surface, wherein the secondary angled surface of one wedge is in contact to the secondary angled surface of the other wedge; a pair of slips located on the tool mandrel and separated from each other by the pair of wedges, each of the slips comprises: an inner surface slidable along the outer surface of the tool mandrel; an outer surface comprising gripping elements configured to grip an inner surface of the casing; and an angled side surface configured to engage with the primary angled surface of the wedge; and a sealing element located on an outer surface of the tool mandrel adjacent to one of the slips.

2. A valve system for inserting into a casing within a downhole environment, comprising: a tool mandrel comprising a passageway therethrough; a check valve assembly coupled to the tool mandrel and operable to allow a fluid flow in a primary direction through the passageway; and a setting system comprising: a wedge located on the outer surface of the tool mandrel, comprising: an inner surface slidable along the outer surface of the tool mandrel; and a primary angled surface; and a secondary angled surface; a pair of slips located on the tool mandrel and separated from each other by the wedge, each of the slips comprises: an inner surface slidable along the outer surface of the tool mandrel; an outer surface comprising gripping elements configured to grip an inner surface of the casing; and an angled side surface configured to engage with the primary or secondary angled surface of the wedge; and a sealing element located on an outer surface of the tool mandrel adjacent to one of the slips.

3. The valve system of paragraph 2, wherein the angled side surface of one slip is in contact with the primary angled surface of the wedge and the angled side surface of the other slip is in contact with the secondary angled surface of the wedge.

4. The valve system according to any one of paragraphs 1-3, wherein the setting system further comprises a set nut or a ratcheting float collar.

5. The valve system of paragraph 4, wherein the setting system comprises the ratcheting float collar and the ratcheting float collar is located around at least a portion of the mandrel adjacent to one of the slips, and wherein the ratcheting float collar comprises a first set of ratchet teeth configured to engage a second set of ratchet teeth on the mandrel.

6. The valve system of paragraph 5, further comprising a second set of ratchet teeth located on the tool mandrel and configured to engage the first set of ratchet teeth on the ratcheting float collar.

7. The valve system of paragraph 6, wherein a ratcheting system comprises the first and second sets of ratchet teeth, and the ratcheting system is operable to radially move the outer surface of the slips towards the inner surface of the casing.

8. The valve system of paragraph 7, wherein the first and second sets of ratchet teeth are engageable to allow outwardly radial movement between the slips and disallow inwardly radial movement of the slips.

9. The valve system according to any one of paragraphs 1-8, wherein the gripping elements comprise teeth or slip buttons configured to grip the inner surface of the casing, and wherein the gripping elements comprise a material selected from the group consisting of ceramic, metal, metal carbide, thermoplastic, and combinations thereof.

10. A valve system insertable into a casing used in a downhole environment, comprising: a tool mandrel comprising a passageway therethrough; a check valve assembly coupled to the tool mandrel and operable to allow a fluid flow in a primary direction through the passageway; a packer mandrel coupled to the tool mandrel and in fluid communication with the passageway of the tool mandrel; and a setting system coupled to the packer mandrel and comprising: a sealing element located on an outer surface of the packer mandrel; a pair of wedges located on the outer surface of the packer mandrel and separated from each other by the sealing element, each of the wedges comprises: an inner surface slidable along the outer surface of the packer mandrel; and an angled surface; and a pair of slips located on the packer mandrel, each of the slips comprises: an inner surface configured to engage the angled surface of the wedge; and an outer surface comprising gripping elements configured to grip an inner surface of the casing.

11. The valve system of paragraph 10, wherein the check valve assembly is located upstream of the packer mandrel relative to the primary direction.

12. The valve system of paragraph 10 or 11, wherein the check valve assembly is located downstream of the packer mandrel relative to the primary direction.

13. The valve system according to any one of paragraphs 10-12, wherein the setting system further comprises a set nut or a ratcheting float collar.

14. The valve system of paragraph 13, wherein the setting system comprises the ratcheting float collar, wherein the ratcheting float collar is located around at least a portion of the tool mandrel adjacent to one of the slips, and wherein the ratcheting float collar comprises a first set of ratchet teeth for engaging the tool mandrel.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A valve system for inserting into a casing within a downhole environment, comprising:

a tool mandrel comprising an outer surface and a passageway therethrough and an axial axis;

a check valve assembly coupled to the tool mandrel and operable to allow a fluid flow only in a primary direction through the passageway; and a setting system comprising:

a pair of wedges located on the outer surface of the tool mandrel, wherein each of the wedges comprises:

an inner surface slidable along the outer surface of the tool mandrel; and a primary angled surface;

a secondary angled surface angled nonparallel with the axial axis of the mandrel, wherein the secondary angled surface of one wedge is in contact to the secondary angled surface of the other wedge;

a pair of slips located on the tool mandrel and separated from each other by the pair of wedges, wherein each of the slips comprises:

an inner surface slidable along the outer surface of the tool mandrel;

an outer surface comprising gripping elements configured to grip an inner surface of the casing; and an angled side surface configured to engage with one of the primary angled surfaces of the wedges; and a sealing element located on the outer surface of the tool mandrel adjacent to one of the slips.

2. The valve system of claim 1, wherein the setting system further comprises a set nut or a ratcheting float collar.

3. The valve system of claim 2, wherein the setting system comprises the ratcheting float collar and the ratcheting float collar is located around at least a portion of the mandrel adjacent to one of the slips, and wherein the ratcheting float collar comprises a first set of ratchet teeth configured to engage a second set of ratchet teeth on the mandrel.

4. The valve system of claim 3, further comprising a second set of ratchet teeth located on the tool mandrel and configured to engage the first set of ratchet teeth on the ratcheting float collar.

5. The valve system of claim 4, wherein a ratcheting system comprises the first and second sets of ratchet teeth, and the ratcheting system is operable to radially move the outer surface of the slips towards the inner surface of the casing.

6. The valve system of claim 5, wherein the first and second sets of ratchet teeth are engageable to allow outwardly radial movement between the slips and disallow inwardly radial movement of the slips.

7. The valve system of claim 1, wherein the gripping elements comprise teeth or slip buttons configured to grip the inner surface of the casing, and wherein the gripping elements comprise a material selected from the group consisting of ceramic, metal, metal carbide, thermoplastic, and combinations thereof.

8. A valve system for inserting into a casing within a downhole environment, comprising:

- a tool mandrel comprising an outer surface and a passageway therethrough;
- a check valve assembly coupled to the tool mandrel and operable to allow a fluid flow in a primary direction through the passageway; and
- a setting system comprising:
  - a single-piece integral wedge located on the outer surface of the tool mandrel, comprising:
    - an inner surface slidable along the outer surface of the tool mandrel;
    - a primary angled surface; and
    - a secondary angled surface;
  - a pair of slips located on the tool mandrel and separated from each other by the integral wedge, wherein each of the slips comprises:
    - an inner surface slidable along the outer surface of the tool mandrel;
    - an outer surface comprising gripping elements configured to grip an inner surface of the casing; and
    - an angled side surface configured to engage with the primary or secondary angled surface of the integral wedge; and
  - a sealing element located on the outer surface of the tool mandrel adjacent to one of the slips.

9. The valve system of claim 8, wherein the angled side surface of one slip is in contact with the primary angled surface of the integral wedge and the angled side surface of the other slip is in contact with the secondary angled surface of the integral wedge.

10. The valve system of claim 8, wherein the setting system further comprises a set nut or a ratcheting float collar.

11. The valve system of claim 10, wherein the setting system comprises the ratcheting float collar, wherein the ratcheting float collar is located around at least a portion of the tool mandrel adjacent to one of the slips, and wherein the ratcheting float collar comprises a first set of ratchet teeth for engaging the tool mandrel.

12. The valve system of claim 11, further comprising a second set of ratchet teeth located on the tool mandrel and configured to engage the first set of ratchet teeth on the ratcheting float collar.

13. The valve system of claim 12, wherein a ratcheting system comprises the first and second sets of ratchet teeth, and wherein the ratcheting system is operable to radially move the outer surface of the slips towards the inner surface of the casing.

14. The valve system of claim 13, wherein the first and second sets of ratchet teeth are engageable to allow outwardly radial movement between the slips and disallow inwardly radial movement of the slips.

15. The valve system of claim 8, wherein the gripping elements comprise teeth or slip buttons configured to grip the inner surface of the casing, and wherein the gripping elements comprise a material selected from the group consisting of ceramic, metal, metal carbide, thermoplastic, and combinations thereof.

16. A valve system insertable into a casing used in a downhole environment, comprising:

- a tool mandrel comprising a passageway therethrough;
- a check valve assembly coupled to the tool mandrel and operable to allow a fluid flow in a primary direction through the passageway;
- a packer mandrel coupled to the tool mandrel and in fluid communication with the passageway of the tool mandrel; and
- a setting system coupled to the packer mandrel and comprising:
  - a sealing element located on an outer surface of the packer mandrel;
  - a pair of wedges located on the outer surface of the packer mandrel and separated from each other by the sealing element, wherein each of the wedges comprises:
    - an inner surface slidable along the outer surface of the packer mandrel; and
    - an angled surface;
  - a pair of slips located on the packer mandrel, wherein each of the slips comprises:
    - an inner surface configured to engage the angled surface of one of the wedges; and
    - an outer surface comprising gripping elements configured to grip an inner surface of the casing; and
  - ratcheting float collar located around at least a portion of the packer mandrel adjacent to one of the slips, and wherein the ratcheting float collar comprises a first set of ratchet teeth for engaging the packer mandrel.

17. The valve system of claim 16, wherein the check valve assembly is located upstream of the packer mandrel relative to the primary direction.

18. The valve system of claim 16, wherein the check valve assembly is located downstream of the packer mandrel relative to the primary direction.

* * * * *